US007248822B2

(12) United States Patent
Yokota et al.

(10) Patent No.: US 7,248,822 B2
(45) Date of Patent: Jul. 24, 2007

(54) IMAGE FORMING APPARATUS

(75) Inventors: Masahiko Yokota, Abiko (JP); Tetsuya Nagase, Abiko (JP); Hiroshi Nakahata, Abiko (JP); Toshihiko Kudo, Toride (JP); Yukihiro Fujiwara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 11/041,203

(22) Filed: Jan. 25, 2005

(65) Prior Publication Data

US 2005/0175375 A1 Aug. 11, 2005

(30) Foreign Application Priority Data

Jan. 30, 2004 (JP) ..... 2004-022747

(51) Int. Cl.
*G03G 15/01* (2006.01)

(52) U.S. Cl. ..... 399/226; 399/227; 399/184

(58) Field of Classification Search ..... 399/226, 399/227, 184

See application file for complete search history.

(56) References Cited

U.S. PATENT DOCUMENTS 5,883,385 A * 3/1999 Takahashi et al. ..... 250/235
6,243,126 B1 * 6/2001 Ueno ..... 347/248
6,701,110 B2 * 3/2004 Ono ..... 399/226
6,813,459 B2 * 11/2004 Kishigami ..... 399/227
6,839,533 B2 * 1/2005 Ban et al. ..... 399/260
7,072,605 B2 * 7/2006 Kishigami ..... 399/227
7,139,513 B2 * 11/2006 Okamoto et al. ..... 399/227
2003/0133719 A1 * 7/2003 Tsuruya et al. ..... 399/12

FOREIGN PATENT DOCUMENTS

JP 10-197810 7/1998
JP 2001-253115 9/2001

* cited by examiner

*Primary Examiner*—Andrew H. Hirshfeld
*Assistant Examiner*—Jeff Natalini
(74) *Attorney, Agent, or Firm*—Fitzpatrick, Cella, Harper & Scinto

(57) ABSTRACT

The present invention relates to an image forming apparatus comprising: an exposing means and a developing means. The developing means comprises a plurality of developing devices, a rotating member rotatable while supporting the plurality of the developing devices, and a driving means for the rotation drive of the rotating member for selectively moving the plurality of the developing devices to the developing position such that the driving means transmits driving force to the rotating member via a gear at a drive transmitting position. An angle θe(°) formed by a straight line linking the rotation center of the rotating member and the drive transmitting position and the tangent of the image bearing member at an exposing position in the image bearing member moving direction satisfies the following relationship with the premise that an pressure angle of the gear is α(°) and the image bearing member rotating direction is positive: $-\alpha \leqq \theta e \leqq \alpha$.

3 Claims, 12 Drawing Sheets

(a)

(b)

IMAGE FORMING APPARATUS

BACKGROUND OF THE INVENTION

1. Field of the Invention

The present invention relates to an image forming apparatus such as a copying machine, a facsimile and a printer. More specifically, it relates to an image forming apparatus comprising a rotatable developing device for developing a plurality of colors, and a transferring means as an intermediate transfer member for forming toner images of a plurality of colors on a photosensitive member and transferring the toner images on the photosensitive member or a rotatable transfer drum supporting a recording medium for transferring the toner images on the photosensitive member to the recording medium.

2. Related Background Art

Conventionally, as the configuration of an apparatus for forming a multiple color image according to an electrophotographic system, a multiple color image is obtained by forming a latent image by the selective exposure on an image bearing member (hereinafter it is referred to as the "photosensitive drum") as a drum shaped electrophotographic photosensitive member charged uniformly by a charging device, disposing a plurality of developing devices storing developing agents (hereinafter it is referred to as the "toners") of different colors on a rotary as a rotation selecting mechanism, developing with the developing device storing a predetermined color faced with respect to the above-mentioned photosensitive drum, transferring the toner image to a recording medium, and furthermore, executing the developing and transferring operations to each color.

There is a method provided with an intermediate transfer member as the recording medium in addition to a paper and an OHP sheet, for temporarily collecting the colors as an intermediate role before the transfer onto the paper or the OHP sheet. A method using an intermediate transfer member comprising for example a resin sheet made of a PET, or the like for the transfer by each color from the photosensitive drum and then transfer onto the paper or the OHP as the recording medium has been proposed.

In the case the positioning accuracy of the colors is low, specifically, in the case displacement of 50% or more with respect to the sub scanning pitch is generated, the unevenness or the color displacement can be observed visibly so that image failure called banding or jitter is generated in many cases. As the cause of the sub scanning displacement, the following two can be presented.

(1) The exposing position (sub scanning position) on the photosensitive drum is displaced due to the mechanical accuracy error, the control error, the speed fluctuation, the internal vibration, and the external vibration.

(2) The transfer position onto the recording medium is displaced due to the mechanical accuracy error, the control error, the speed fluctuation, the internal vibration, and the external vibration.

In order to improve the image failures, the following proposals have been provided as the conventional inventions.

The laser beam displacement in the sub scanning direction is detected by an photo electric conversion element, and the laser exposing position is adjusted in the sub scanning direction by a galvano mirror disposed on the front side of a polygon mirror (see the Patent Article 1).

The polarizing mirror for an exposing beam is corrected constantly by detecting the dynamic pitch fluctuation in the sub scanning direction by measuring the speed fluctuation of the photosensitive drum by an encoder, or the like. Moreover, the frequency of a writing clock is corrected according to the correction amount (see the Patent Article 2).

[Patent Article 1] The official gazette of the Japanese Patent Application Laid Open (JP-A) No. 2001-253115

[Patent Article 2] The official gazette of the Japanese Patent Application Laid Open (JP-A) No. 10-197810

However, as shown in the conceptual diagrams of FIGS. 11 and 12, according to the conventional method, in a process for producing an electrostatic latent image on a photosensitive drum by an optical means such as a laser beam, at the time a developing rotary having a large rigidity starts or stops moving (see B1 of FIG. 11), the units of the copying machine main body may be vibrated. Particularly in the case the vibration is transmitted to the laser unit (see B2 of FIG. 11), the scanning interval in the sub scanning direction is displaced so that stripes called banding or jitter are generated (see B3 of FIG. 11).

Then, according to the above-mentioned conventional examples, for example, methods of preliminarily detecting the laser unit vibration by a detecting means such as a vibration sensor for vibrating the laser beam in the opposite phase based on the data, controlling the angle of the mirror in the optical system, controlling the rotation speed of the photosensitive drum, or the like have been proposed. However, due to the need of a special mechanism such as the detecting means and the correcting means, the apparatus cost is increased.

SUMMARY OF THE INVENTION

Accordingly, an object of the present invention is to provide an image forming apparatus capable of reducing the banding, which causes the vibration that generates the rotation and the stoppage of the rotary developing device without complicating the mechanism.

In order to achieve the above-mentioned object, a preferable image forming apparatus comprises:

an exposing means for forming an electrostatic image by executing the scanning exposure in the main scanning direction with respect to an image bearing member moving in the sub scanning direction;

a developing means for developing the above-mentioned electrostatic image at a developing position, comprising a plurality of developing devices, a rotating member rotatable while supporting the plurality of the developing devices, and a driving means for the rotation drive of the above-mentioned rotating member for selectively moving the plurality of the developing devices to the developing position such that the above-mentioned driving means transmits the driving force to the above-mentioned rotating member via a gear at a drive transmitting position, wherein an angle $\theta e(°)$ formed by a straight line linking the rotation center of the above-mentioned rotating member and the above-mentioned drive transmitting position and a tangent of the above-mentioned image bearing member at an exposing position in the image bearing member moving direction satisfies the following relationship with the premise that a pressure angle of the above-mentioned gear is $\alpha(°)$ and the above-mentioned image bearing member rotating direction is positive:

$$-\alpha \leqq \theta e \leqq \alpha.$$

another preferable embodiment of an image forming apparatus comprises:

an exposing means for forming an electrostatic image by executing the scanning exposure in the main scanning direction with respect to an image bearing member moving in the sub scanning direction;

a developing means for developing the above-mentioned electrostatic image at a developing position, comprising a plurality of developing devices, a rotating member rotatable while supporting the plurality of the developing devices, and a driving means for the rotation drive of the above-mentioned rotating member for selectively moving the plurality of the developing devices to the developing position such that the above-mentioned driving means transmits the drive to the above-mentioned rotating member at a drive transmitting position, wherein the angle formed by the tangent of the above-mentioned image bearing member at the above-mentioned drive transmitting position in the image bearing member moving direction and the tangent of the above-mentioned image bearing member at the exposing position in the image bearing member moving direction is substantially perpendicular.

Moreover, still another preferable embodiment of an image forming apparatus comprises:

an image bearing member for forming an electrostatic image;

a developing means for developing the electrostatic image on the above-mentioned image bearing member by a developing agent, comprising a plurality of developing devices, a rotating member rotatable while supporting the plurality of the developing devices, and a driving means for the rotation drive of the above-mentioned rotating member for selectively moving the plurality of the developing devices to the developing position such that the above-mentioned drive transmitting means transmits the drive to the above-mentioned rotating member via a gear at a drive transmitting position, and a transfer means for transferring the developing agent image on the above-mentioned image bearing member to a transfer medium at a transfer position;

wherein the angle $\theta t(°)$ formed by the straight line linking the rotation center of the above-mentioned rotating member and the above-mentioned drive transmitting position and the tangent of the above-mentioned image bearing member at the transfer position in the image bearing member moving direction satisfies the following relationship with the premise that the pressure angle of the above-mentioned gear is $\alpha(°)$ and the above-mentioned image bearing member rotating direction is positive:

$$-\alpha \leqq \theta t \leqq \alpha.$$

furthermore, still another preferable embodiment of an image forming apparatus comprises:

an image bearing member for forming an electrostatic image;

a developing means for developing the electrostatic image on the above-mentioned image bearing member by a developing agent, comprising a plurality of developing devices, a rotating member rotatable while supporting the plurality of the developing devices, and a driving means for the rotation drive of the above-mentioned rotating member for selectively moving the plurality of the developing devices to the developing position such that the above-mentioned drive transmitting means transmits the drive to the above-mentioned rotating member via a gear at a drive transmitting position, and a transfer means for transferring the developing agent image on the above-mentioned image bearing member to a transfer medium at a transfer position;

an image bearing member for forming an electrostatic image;

a developing means for developing the electrostatic image on the above-mentioned image bearing member by a developing agent, comprising a plurality of developing devices, a rotating member rotatable while supporting the plurality of the developing devices, and a driving means for the rotation drive of the above-mentioned rotating member for selectively moving the plurality of the developing devices to the developing position such that the above-mentioned drive transmitting means transmits the drive to the above-mentioned rotating member at a drive transmitting position, and a transfer means for transferring the developing agent image on the above-mentioned image bearing member to a transfer medium at a transfer position;

wherein the angle formed by the tangent of the above-mentioned image bearing member at the above-mentioned drive transmitting position in the image bearing member moving direction and the tangent of the above-mentioned image bearing member at the transfer position in the image bearing member moving direction is substantially perpendicular.

DESCRIPTION OF THE PREFERRED EMBODIMENTS

First Embodiment

Figure 1:
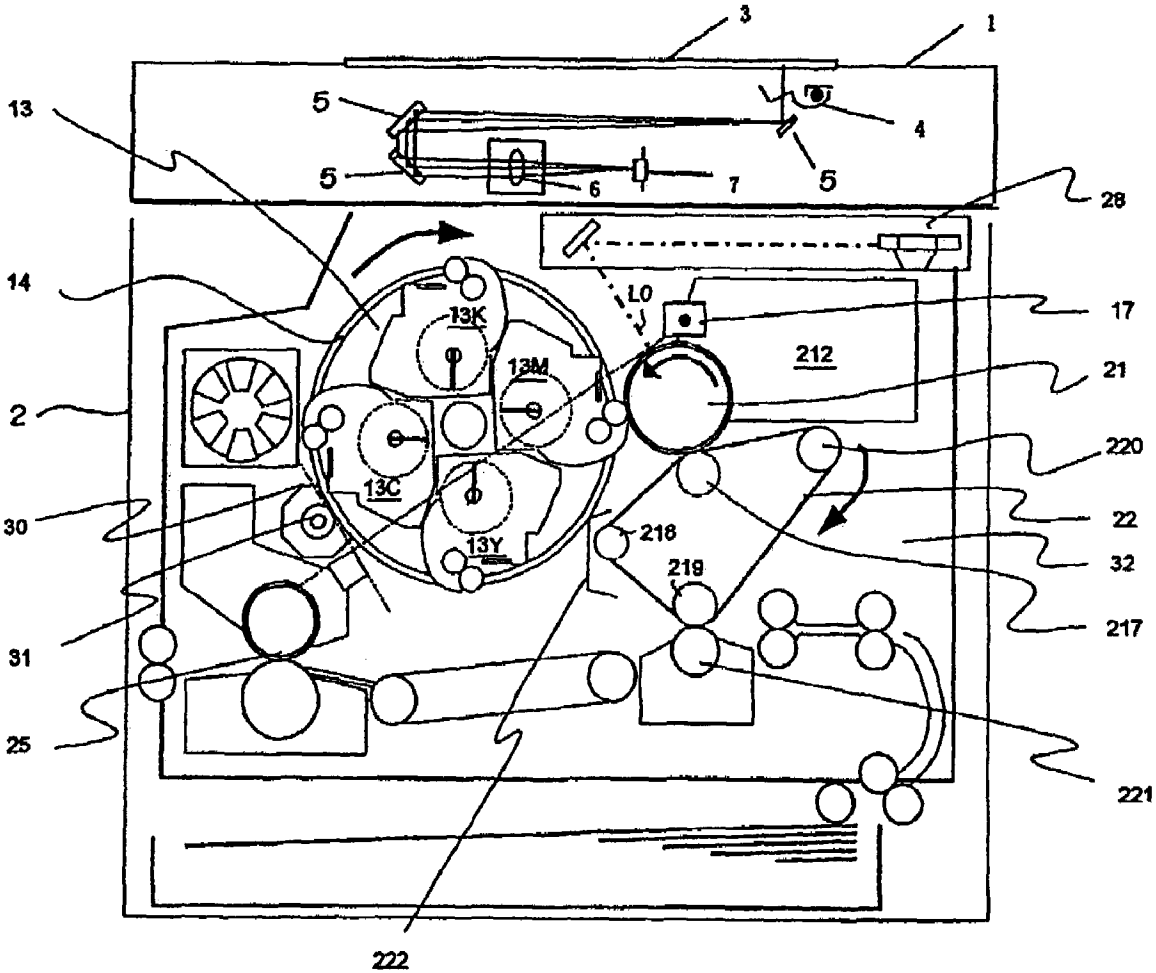
FIG. 1 is an entire schematic explanatory diagram of an image forming apparatus according to an embodiment of the present invention.

Hereinafter, a first embodiment of adopting the present invention to a one drum system color copying machine having one photosensitive member will be explained. FIG. 1 is a schematic configuration diagram of the entirety of a color copying machine according to the first embodiment.

Here, the entire configuration of the image forming apparatus will be explained first, and then, the driving system arrangement configuration of the rotary will be explained.

{Entire Configuration of the Image Forming Apparatus}

First, with reference to FIG. 1, the color image reading device (hereinafter, it is referred to as the "color scanner") 1 and a color image recording device (hereinafter, it is referred to as the "color printer") 2 comprising the color copying machine will be explained schematically.

The above-mentioned color scanner focuses the image of a document 3 onto a photoelectric conversion element 7 storing a color filter via an illumination lamp 4, a mirror 5 and a lens 6 for converting the color image information of the document into electric image signals per color separation beams of for example, blue (B), green (G), and red (R). Then, based on the color separation image signal intensity levels of B, G, R obtained by the color scanner 1, the color conversion process is executed by the image processing part (not shown) so as to obtain the color image data of black (K), cyan (C), magenta (M) and yellow (Y).

According to the above-mentioned color printer 2, the color image data read out by the color scanner 1 are converted to light signals so as to send out the same to an optical unit 28 as an exposing means as the exposing signals.

After uniformly charging the surface of a photosensitive drum 21 as the image bearing member as an electrophotographic photosensitive member by a charging device 17, a latent image is formed by directing a laser beam according to the image information from the optical unit 28 so as to form an electrostatic latent image on the photosensitive drum 21. The photosensitive drum 21 is rotated counterclockwise shown by the arrow in FIG. 1. Around the same, a photosensitive member cleaning unit (including a pre cleaning charge removing device) 212 and a developing rotary 13 having a magenta developing device 13M, a cyan developing device 13C, an yellow developing device 13Y and a black developing device 13K supported by a rotating member are provided such that the developing rotary 13 is rotated for the image formation with a predetermined color toner so as to have the rotation control for having the photosensitive drum 21 contacted with the developing device of the predetermined color.

Moreover, it is hanged around an intermediate transfer belt 22 as an intermediate transfer member, a first transfer bias roller 217 as a first transfer means, a driving roller 220 for driving the intermediate transfer belt 22 by an unshown motor, and driven rollers 218, 219.

The developing devices in each of the above-mentioned image forming systems comprise an unshown developing sleeve to be rotated while having the head of the toner contacted with the surface of the photosensitive drum 21 for developing the electrostatic latent image, an unshown developing paddle to be rotated for pumping up and agitating the toner, or the like.

Moreover, a second transfer bias roller 221 disposed at a position facing the driven roller 219 of the intermediate transfer belt 22 is provided with a separating and contacting mechanism for the drive for separating from or contacted with the intermediate transfer belt 22.

Then, after transferring secondarily the image transferred onto the intermediate transfer belt 22 onto a paper or an OHP as the recording medium, the recording medium is conveyed to a fixing device 25 so that the toner is molten by the heat and pressure so as to be fixed onto the recording medium, and then it is discharged to the outside of the machine.

Moreover, a belt cleaning unit 222 is provided at a predetermined position on the surface of the intermediate transfer belt 22, facing the driven roller 218. As to the contacting and separating operation timing of the belt cleaning unit 222, it is separated from the belt surface from the start of printing to the finish of the belt transfer of the image rear end part of the final color. Then, at a predetermined timing thereafter, it is contacted with the belt surface by the contacting and separating mechanism (not shown) for cleaning.

{Rotary Driving System}

Then, with reference to FIG. 2, the rotary driving system disposing configuration of this embodiment will be explained. The photosensitive drum 21 is rotated by a constant speed in the arrow B direction during the exposing operation by a laser beam L0 from the optical unit 28. At the time, the developing rotary 13 is in a stopped state so that one of the four color developing devices 13C, 13Y, 13M, 13K supplies the toner to the electrostatic potential image on the photosensitive drum 21. The above-mentioned exposing operation is executed by scanning with a laser beam in the main scanning direction (drum rotation axis direction) with respect to the surface of the photosensitive drum rotating in the sub scanning direction (drum rotation direction).

At the time the exposure and developing of the image rear end are finished, the driving motor 30 rotates the rotary 13 in the arrow A direction and stops the same at a position to have the developing device of the next color contacted with the photosensitive drum 21. During the operation, the process of transferring the image onto the intermediate transfer belt 22 is continued with the photosensitive drum 21 located at the transfer position T.

Here, the relationship between the rotation and the stoppage of the developing rotary 13 and the banding will be explained. The banding is generated by the influence of the vibration transmitted from the developing rotary 13 to the photosensitive drum 21 at the time of the image transfer from the photosensitive drum 21 to the intermediate transfer belt 22 and at the time of the image exposure form the optical unit 28 to the photosensitive drum 21. Then, as to the force derived from the above-mentioned vibration, the force in the sub scanning tangent direction at the image transfer position T and the image exposing position E of the photosensitive drum 21, that is, the force parallel to the tangent direction at the image exposing position E of the photosensitive drum is the cause of generating the banding. With the force provided larger, the banding can be generated easily.

(At the Time the Developing Rotary is Rotated)

Figure 3:
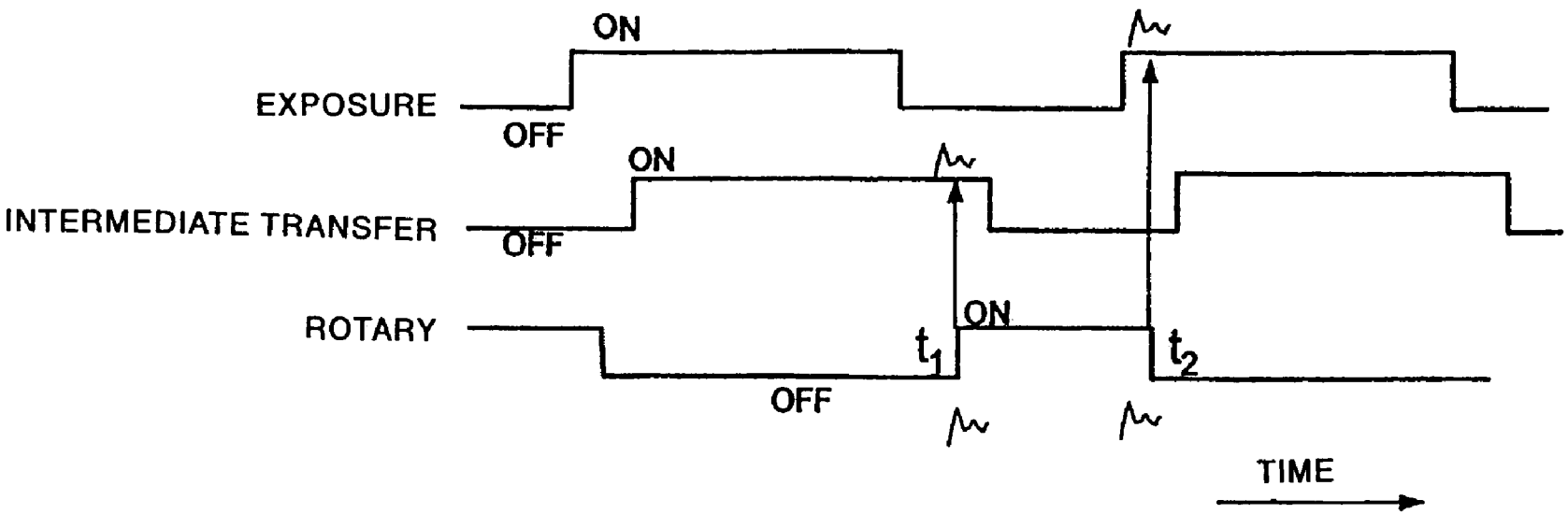
FIG. 3 is a timing chart showing the vibration generating timing.

Then, first, the case of starting the rotation of the developing rotary 13 will be explained. At the time of starting the rotation of the rotary 13, in the case the driving motor 30 is rotated, a pinion gear 31 is engaged with a rotary gear 14 provided at the rotary outer circumferential part so that the rotary 13 is rotated in the arrow A direction at the time the driving motor 30 starts the drive. At the time, the driving force for rotating the developing rotary 13 having a large rigidity by the pinion gear 31 of the motor is turned on at the timing t1 shown in FIG. 3 with respect to the developing rotary 13 so as to be transmitted. FIG. 3 shows the timings of the exposure to the photosensitive drum 21, the image transfer from the photosensitive drum 21 to the intermediate transfer belt 22, and the rotation of the developing rotary 13.

At the time, the direction of the force to be the cause of the vibration generation to be transmitted to the developing rotary 13 (hereinafter, it is referred to as the "vibration applying force") is in the P1 direction of FIG. 2. This is transmitted by the rotation center axis of the developing rotary 13 so as to provide the vibration to the frame 32 (see FIG. 1) for supporting the entire image forming unit. Since the frame 32 has the rigidity having a specific natural frequency and binding conditions at a plurality of portions, as to the vibration applying force direction, it is mostly in the vector direction of the engagement of the pinion gear 31 of the driving motor 30 and the gear 14 of the developing rotary 13, that is, the direction inclined by the gear pressure angle α with respect to the tangent direction of the developing rotary 13 and the driving motor 30, and thus it is in the P1 direction of FIG. 2.

Here, according to the configuration of this embodiment, the direction of the straight line linking the rotation center of the rotary 13 and the drive transmitting point to the developing rotary 13 by the pinion gear 13 is provided substantially parallel with respect to the above-mentioned sub scanning tangent direction (image bearing member moving direction). The angle formed by the straight line linking the rotation center of the rotary 13 and the drive transmitting point, and the tangent at the image bearing member transfer position T is θt. In this embodiment, the apparatus configuration is provided such that the tangent at the image bearing member exposing position E and the tangent at the image bearing member transfer position T are substantially parallel. Therefore, the above-mentioned state of "substantially parallel" denotes that the values of θe and θt are substantially zero. In these states, since the component of the force in the sub scanning tangent direction at the transfer position T, that is, in the direction parallel to the tangent direction at the transfer position T of the photosensitive drum is a small value of P1·sin α, the banding can hardly be generated in the sub scanning direction at the transfer position T. For example, in the case the pressure angle α is 20°, the component of the vibration applying force parallel to the sub scanning tangent direction is about 34% of P1.

On the other hand, in the case the driving motor 30 is at a position shown in FIG. 4 (θe and θt are about 90°), the vibration applying force P3' generated by the driving force P3 is as follows as the component parallel to the sub scanning tangent direction at the transfer position T.

$$P3'=P3\cdot\mathrm{Sin}\ \{(\pi/2)+\alpha\}$$

In this case, for example, in the case the pressure angle α is 20°, since it is about 94% of P3, the banding at the transfer position can easily be generated.

After finishing the transfer and emitting an exposing signal for the next color from the optical unit 28, the developing rotary 13 takes out the next color at the developing position S (see FIG. 2) of the photosensitive drum 21 and stops.

(At the Time the Developing Rotary is Stopped)

Figure 5:
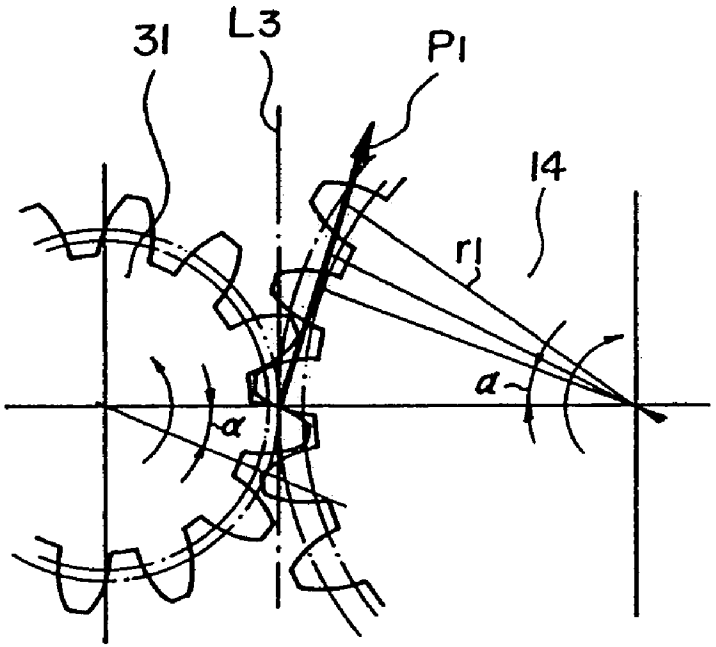
FIG. 5A is an explanatory diagram of the direction of the motive power transmitting direction at the time, of starting the drive of the motor.
FIG. 5B is an explanatory diagram of the direction of the motive power transmitting direction at the time of stopping the motor.
Figure 5:
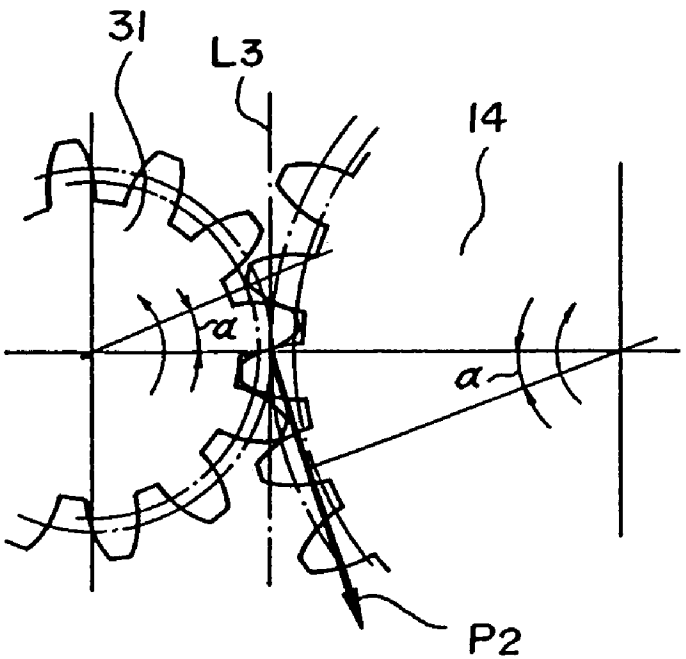

Next, the case of stopping the rotation of the developing rotary 13 will be explained. The motive power transmitting vector at the time the pinion gear 31 of the driving motor 30 and the rotary gear 14 are engaged is shown in FIGS. 5A and 5B. FIG. 5A showing the gear surface pressure direction and the size at the time the rotary 13 starts the rotation by P1, represents the state of the driving force transmission from the pinion gear 31 to the rotary gear 14 to the pressure angle α direction to the rotary side with respect to the pitch circle tangent direction L3.

On the other hand, FIG. 5B showing the gear surface pressure direction and the size at the time the rotary 13 is stopped by P2, represents the state of the braking force transmission from the pinion gear 31 of the motor to the rotary gear 14 to the pressure angle α direction to the rotary side with respect to the pitch circle tangent direction L3.

Figure 2:
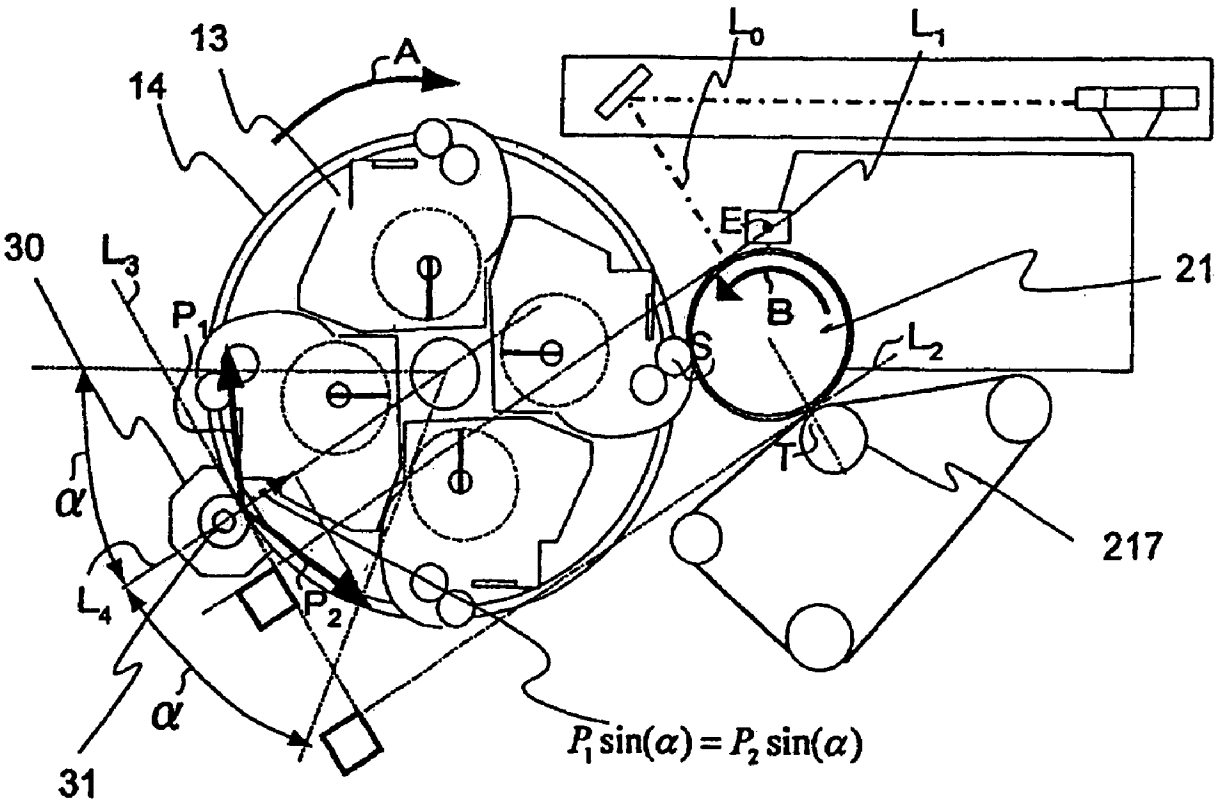
FIG. 2 is an explanatory diagram showing the direction of a drive transmitting force to a developing rotary.

At the time, the vibration applying force to be transmitted to the developing rotary 13 is in the P2 direction in FIG. 2 so that the vibration is applied to the frame 32 for supporting the entirety of the image forming unit via the central axis of the developing rotary 13 as in the above-mentioned case of starting the drive of the rotary. The angle thereof is in the direction inclined by the gear pressure angle α with respect to the tangent reaction of the developing rotary 13 and the driving motor 30, that is, in the P2 direction in FIG. 2.

Here, as mentioned above, in this embodiment, the direction of the straight line linking the rotation center of the rotary 13 and the drive transmitting point from the pinion gear 31 to the developing rotary 13 is substantially parallel to the sub scanning tangent direction at the exposing position E. Therefore, since the component of the force parallel to the sub scanning tangent direction at the exposing position E is the value as small as P2·Sin α, the banding can hardly be generated in the sub scanning direction at the exposing position E. For example, in the case the pressure angle α is 20°, the component of the vibration applying force parallel to the sub scanning tangent direction is about 34% of P2.

Then, also in the case the driving motor 30 is at a position shown in FIG. 4, the vibration applying force P4' generated by the driving force P4 is as follows as the parallel component at the exposing position E.

$$P4'=-P4\cdot\mathrm{Sin}\ \{(\pi/2)-\alpha\}$$

In this case, for example, in the case the pressure angle α is 20°, since it is about 94% of P4, the banding at the exposing position E can easily be generated.

(Arrangement for Lowering the Banding)

From the description mentioned above, the banding can be lowered by the arrangement with the driving motor 30 position of the following conditions.

(1) The pitch circle tangent L3 between the driving motor 30 and the gear 14 of the developing rotary 13 (see FIG. 2) is substantially perpendicular to the tangent L1 of the photosensitive drum 21 at the exposing position E (see FIG. 2).

(2) The tangent L2 between the photosensitive drum 21 a the transfer position T and the intermediate transfer belt 22 (see FIG. 2) is substantially perpendicular to the pitch circle tangent L3 between the driving motor 30 and the gear 14 of the developing rotary 13.

(3) It is preferable that the laser beam L1 is directed perpendicularly with respect to the photosensitive drum surface because the exposing position is vibrated if the photosensitive drum 21 is vibrated in the vertical direction with respect to the sub scanning direction in the case it is directed with an inclination.

In the case of the above-mentioned arrangement, the vibration applying force to the sub scanning direction, which can be the cause of the banding of the gear surface load P of the pinion gear 31 of the driving motor 30, of a flat gear is P·Sin α (gear pressure angle α).

In the case a helical gear is used as the gear, the vibration applying force is (the skew angle of the helical gear is β), P·tan α/cos β.

Although an example of driving the rotary 13 directly by the pinion gear 31 of the driving motor 30 has been presented in this embodiment, a plurality of gear rows may be provided between the driving motor 30 and the rotary 13. In this case, the position of the gear for inputting the motive power to the rotary 13 is provided in the above-mentioned positive and negative pressure angle range (within ±α).

According to the above-mentioned configuration, the vibration generated in the sub scanning direction at the exposing or image transfer position at the time of rotating or stopping the rotary can be minimized so that the banding can be reduced at a low cost without the need of using a special device or executing a control.

Then, in the case the laser beam L1 is directed substantially perpendicular to the photosensitive drum surface so that the exposing light thereof and the functioning direction of the driving force for rotating the rotary are provided substantially parallel, the influence of the vibration generated in the drive transmission can hardly appear as the vibration phase component parallel to the sub scanning tangent direction at the exposing position.

Moreover, in the case the tangent direction L2 of the photosensitive drum 21 at the above-mentioned transfer position T at the time is provided substantially parallel to the sub scanning tangent direction 11 at the above-mentioned exposing position E, the direction of the vibration generated at the drive transmitting position to the rotary is substantially perpendicular each at the exposing position E and the transfer position T so that it can hardly appear as the vibration phase component parallel to the sub scanning direction, which can easily generate the banding.

The gear is not limited to a flat gear and a helical gear. Also with a bevel gear or a worm gear, the problem of the banding can be solved by setting the arrangement according to the motive power transmitting direction.

As heretofore explained, according to this embodiment, the vibration generated both at the time of starting and stopping the drive of the driving motor can be restrained in a well balanced manner.

Second Embodiment

Next, an apparatus according to the second embodiment will be explained with reference to FIGS. 6 to 8. Since the basic configuration of the apparatus of this embodiment is same as that of the above-mentioned embodiment, redundant explanation is omitted, and the configuration characteristic of this embodiment will be described. The same numerals are applied to the members having the same functions as those of the above-mentioned embodiment.

Although the above-mentioned first embodiment has the configuration of reducing the vibration both at the time of starting and stopping the drive of the driving motor 30, according to this embodiment, the vibration of either one is further reduced. For example, in the case of a structure with the vibration transmitted hardly at the transfer position T, a configuration of reducing the vibration mainly at the exposing position E can be provided. On the contrary, in the case of a structure with the vibration transmitted hardly to the exposing position E, a configuration of reducing the vibration mainly at the transfer position T can be provided.

Figure 6:
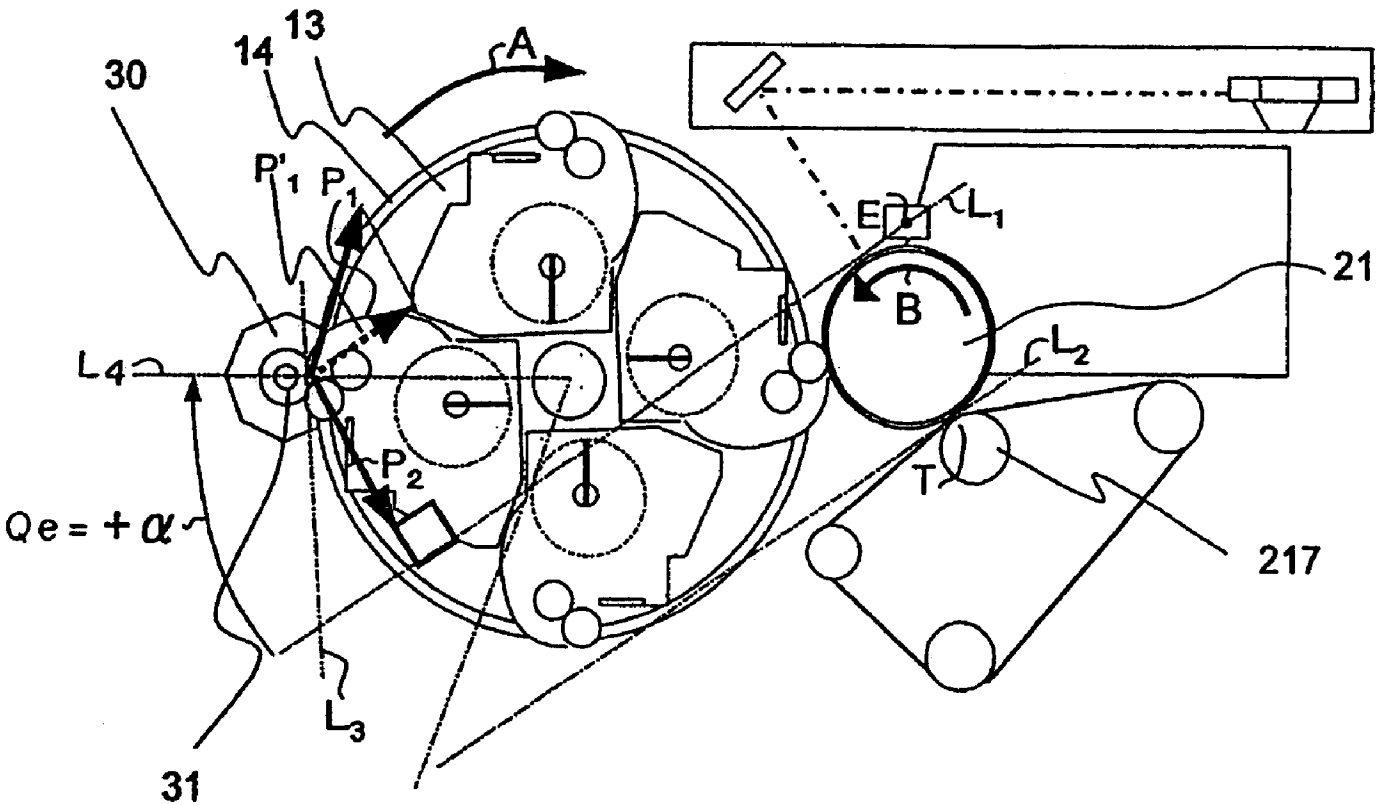
FIG. 6 is an explanatory diagram in the case the drive transmitting position to the rotary is set at a positive pressure angle position of the drive transmitting gear.

FIG. 6 shows the state of the driving motor 30 at the position rotated by the clockwise angle α (α is the pressure angle of the pinion gear 31 of the motor and the rotary gear 14) in the sub scanning direction L2 with respect to the center of the developing rotary 13.

Figure 7:
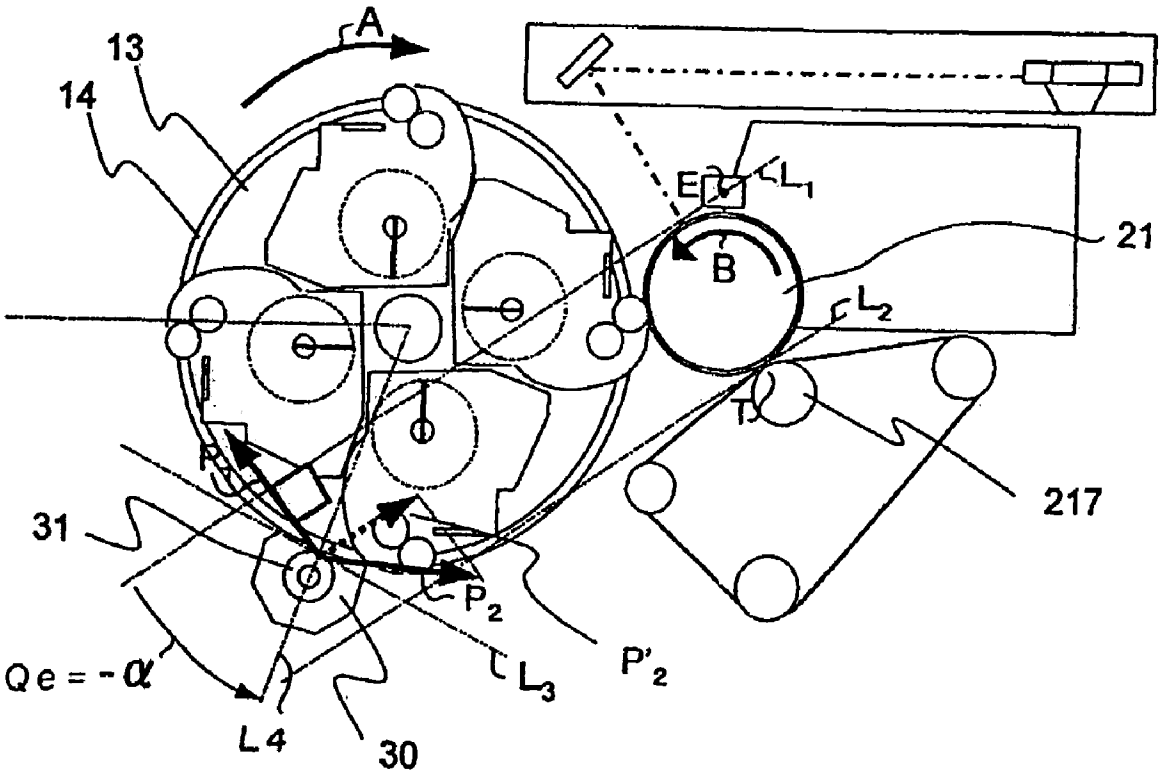
FIG. 7 is an explanatory diagram in the case the drive transmitting position to the rotary is set at a negative pressure angle position of the drive transmitting gear.

FIG. 7 shows the state of the driving motor 30 at the position rotated by the counterclockwise angle α in the sub scanning direction L2 with respect to the center of the developing rotary 13.

In these figures, P1 is the force functioned at the time of rotating the developing rotary 13 by the driving motor 30, and P1' is the P1 component generated in the sub scanning direction L1 at the time, which is the vibration applying force. Moreover, P2 is the force applied from the developing rotary 13 at the time of stopping the driving motor 30, and P2' is the P2 component generated in the sub scanning direction at the time, which is the vibration applying force as well.

FIGS. 6, 7 show the driving motor 13 arrangement limit for providing the effect of reducing the vibration, which is the object of the present invention. FIG. 4 mentioned above shows the case of having the driving motor outside the pressure angle (in the range wider than ±α).

Figure 4:
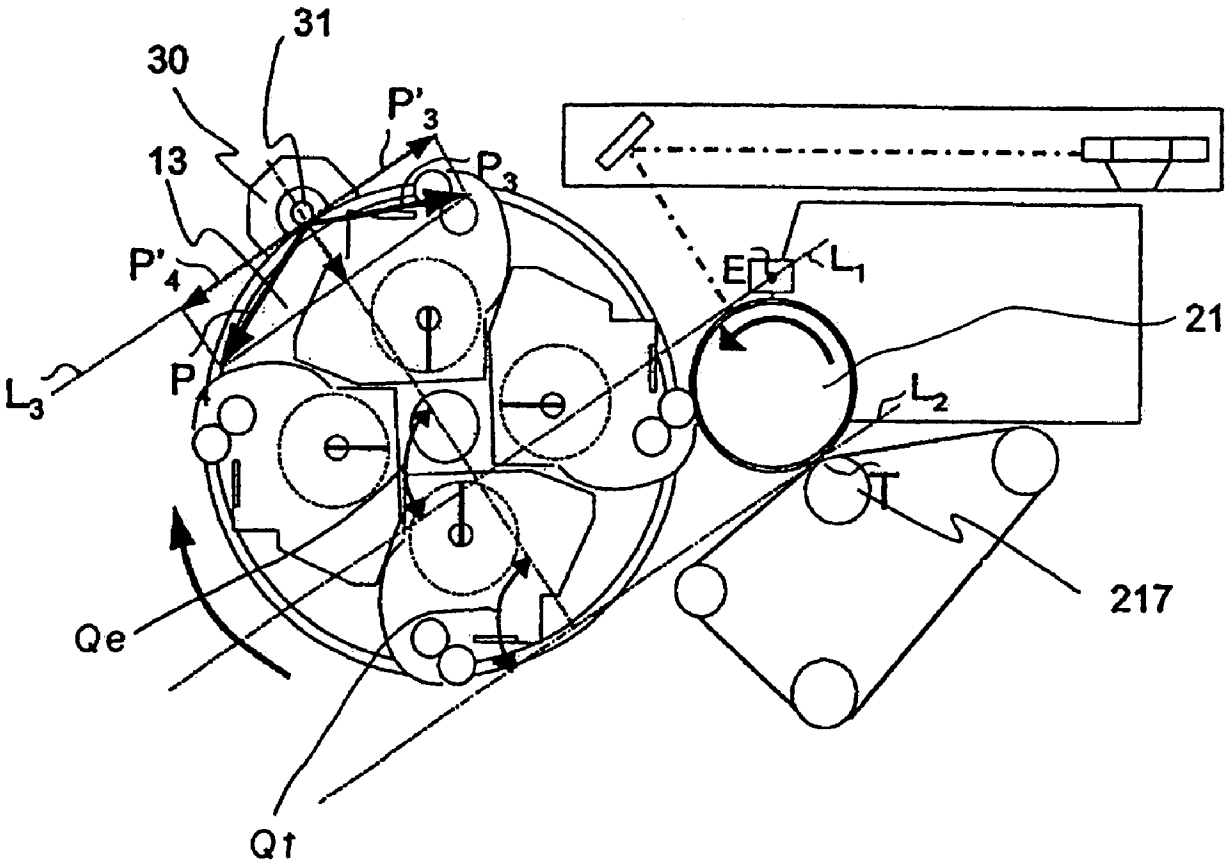
FIG. 4 is an explanatory diagram of a configuration example easily generating the banding.

In FIG. 4, P3 is the force functioned at the time of rotating the developing rotary 13 by the driving motor 30, and P3' is the P3 component generated in the sub scanning direction L1 at the time, which is the vibration applying force. P4 is the force applied from the developing rotary 13 at the time of stopping the driving motor 30, and P4' is the P4 component generated in the sub scanning direction at the time, which is the vibration applying force as well. In the case of the arrangement shown in FIG. 4, since the vibration applying forces P3', P4' are large as mentioned above, the banding can easily be generated.

Figure 8:
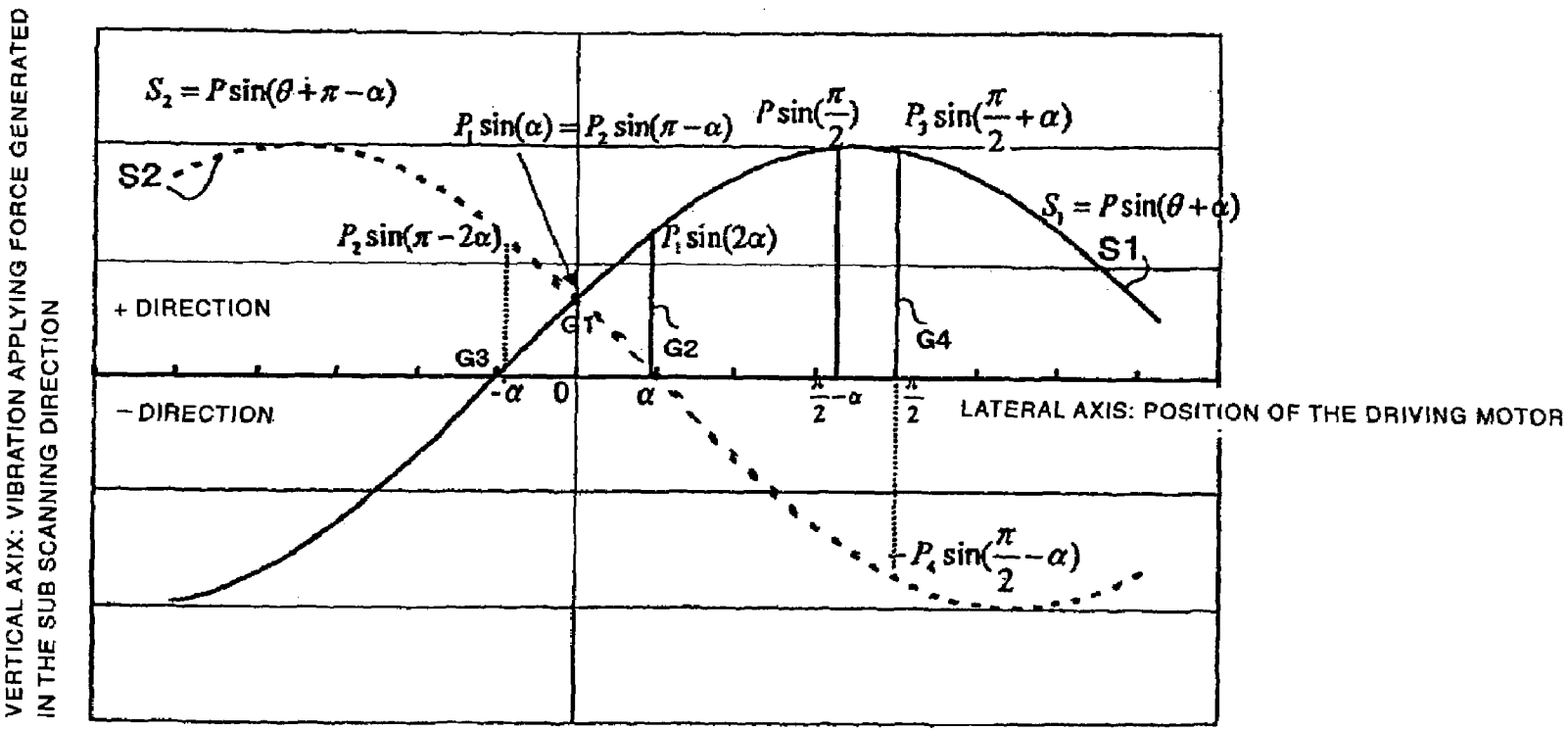
FIG. 8 is a graph showing the motor position and the motive power transmitting direction at the time of starting the drive of the motor.

FIG. 8 shows the degree of the vibration applying force generation according to the position of the driving motor 30 with respect to the developing rotary 13.

In FIG. 8, the lateral axis denotes the angle showing the driving motor 30 arrangement position. The center 0 represents the angle parallel to the sub scanning direction L1, +α denotes the position away for the pressure angle in the clockwise direction, and −α denotes the position away for the pressure angle in the counterclockwise direction.

The vertical axis represents the power component parallel to the sub scanning directions L1 and L2, with the photosensitive drum 21 direction provided as positive.

The lateral axis represents the angle showing the direction of the straight line L4 linking the center of the driving motor 30 and the center of the developing rotary 13. 0° denotes the position parallel to the sub scanning direction L1 at the exposing position E and the sub scanning direction L2 at the transfer position T. In this embodiment, since L1 and L2 are parallel, L1 and L2 are described in the same vertical axis in FIG. 8. In the case L1 and L2 are not parallel, a lateral axis needs to be prepared independently for each of them.

α is the pressure angle of the rotary gear 14. The solid line S1 in FIG. 8 is the sub scanning direction vibration applying force at the time of starting the drive of the driving motor 30, and the broken line S2 is the sub scanning direction vibration applying force at the time of stopping the driving motor 30. Each S1 and S2 can be represented as a function of the angle θ as follows (α is the pressure angle).

$$S1=P\cdot\mathrm{Sin}(\theta+\alpha)$$

$$S2=P\cdot\mathrm{Sin}(\theta+\pi-\alpha)$$

G1 in FIG. 8 represents the state with the driving motor 30 disposed at the FIG. 2 position, and G2 represents the state at the FIG. 6 position.

As shown in FIG. 6, when the drive transmitting position from the driving motor 30 to the rotary gear 14 is at the +α position with respect to the sub scanning direction L1, the vibration applying force at the time of the stoppage as the sub scanning direction L2 component is 0, and the vibration applying force at the time of starting the drive is P1'=P1·Sin (2α), (In the above-mentioned formula, α is represented by the radian).

Therefore, according to the sequence in FIG. 3, since the maximum vibration applying force is functioned to the transfer position T to the intermediate transfer belt 22 at the time t1 of starting the drive of the driving motor 30 and the vibration applying force is hardly generated at the time of the stoppage, the banding generation can be restrained at the exposing position E at the time t2. In the case the pressure angle $\alpha$ is 20°, the vibration applying force P1' has a size of about 64% of the force P1 functioning at the time of rotating the developing rotary 13 by the driving motor 30.

Moreover, on the other hand, as shown in FIG. 7, at the time the driving motor 30 is at the $-\alpha$ position with respect to the sub scanning direction L1, the vibration applying force is 0, and the vibration applying force at the time of starting the drive is also $P2'=P2\cdot\mathrm{Sin}(\pi-2\alpha)$ in the case P1=P2, (In the above-mentioned formula, $\alpha$ is represented by the radian).

Therefore, according to the sequence in FIG. 3, since the vibration applying force is barely functioned to the transfer position T at the time t1 of starting the drive of the driving motor 30 and the vibration applying force functions on the exposing position E at the time of the stoppage, the banding generated by the transfer can be restrained. In the case the pressure angle $\alpha$ is 20°, the vibration applying force P2' has a size of about 64% of the force P2 applied from the developing rotary 13 at the time of stopping the driving motor 30.

On the other hand, in the case the driving motor 30 position is outside the $\pm\alpha$ range with respect to the sub scanning direction L1 at the exposing position E, the vibration applying force is made larger both at the time of starting and stopping the drive of the driving motor 30. Especially at the position shown in FIG. 4, as to the vibration applying force in the sub scanning direction L1, P3', P4' are as follows as shown by G4 in FIG. 8 regardless of the drive or the stoppage of the driving motor 30 so that the risk of generating a large banding is extremely high.

$$P3'=P3\cdot\mathrm{Sin}\ \{(\pi/2)+\alpha\}$$

$$P4'=-P4\cdot\mathrm{Sin}\ \{(\pi/2)-\alpha\}$$

In the case of the above-mentioned arrangement of FIG. 4, in the case the pressure angle $\alpha$ is 20°, P3', P4' have a size of about 64% of P3, P4, respectively.

That is, in the case the driving motor 30 is within $\pm\alpha$ (if $\alpha$ is 20°, ±20°) in the direction of the sub scanning direction L1 or L2 with respect to the center of the developing rotary 13, the vibration applying force in the sub scanning direction is small so that the banding can be reduced.

Figure 9:
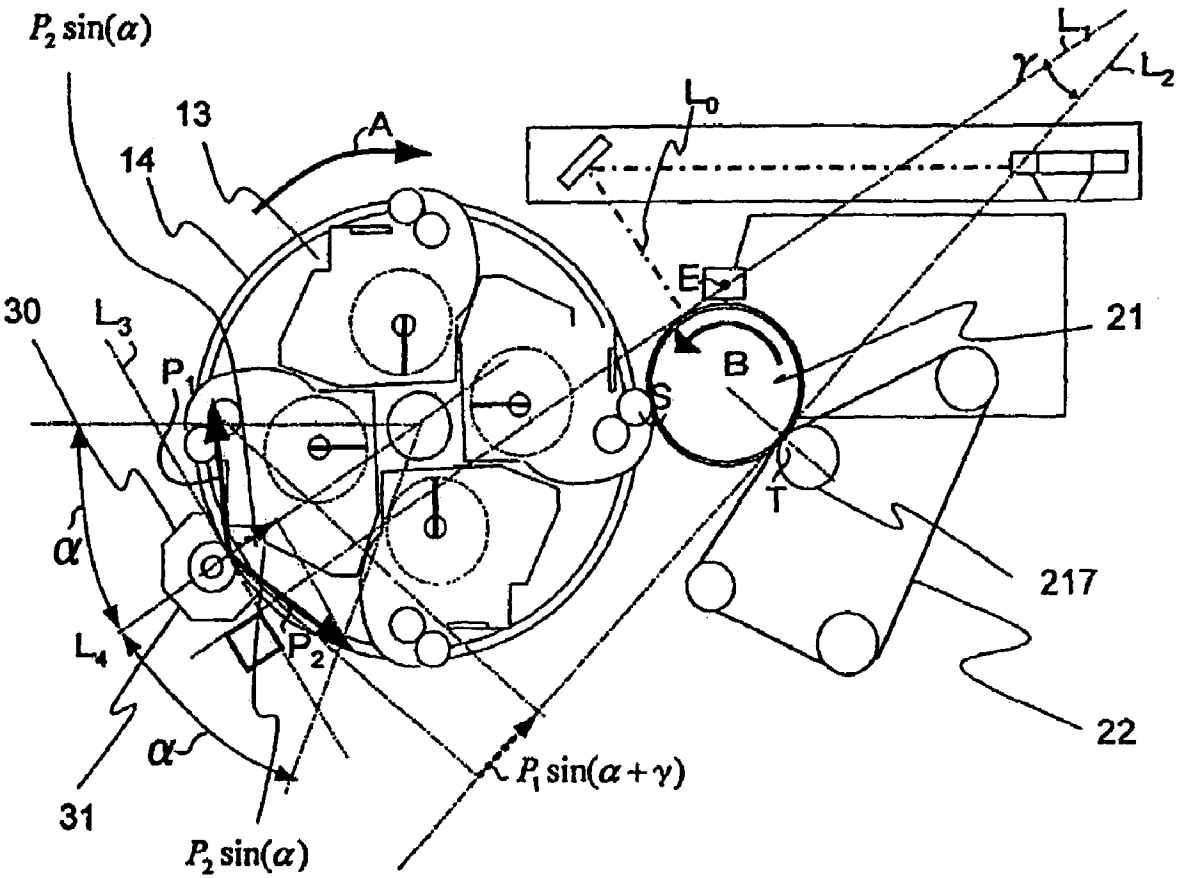
FIG. 9 is a configuration explanatory diagram in the case the sub scanning tangent direction at the exposing position and the sub scanning tangent direction at the transfer position are not parallel, but are disposed with an inclination.

In the case the sub scanning tangent direction L1 at the exposing position E and the sub scanning tangent direction 12 at the transfer position T are not parallel but have an inclination Y as shown in FIG. 9, the vibration applying force generated in the transfer sub scanning direction 12 due to the start of the rotary rotation is:

$$P1'=P1\cdot\mathrm{Sin}(\alpha+Y).$$

Although an example of a 20° pressure angle has been explained in the above-mentioned first and second embodiments, the range of the gear pressure angle to be applied to the present invention is 14° or more and 20° or less. With a gear having less than 14° angle, the gear strength is weakened due to the thinness of the gear dedendum. As a result, the durability is lowered so as to easily generate the driving irregularity due to the gear deformation or breakage so that the image unevenness can be caused thereby, and thus it is not preferable. On the other hand, with a gear having more than 20° angle, the power component in the rotary 13 rotation axis direction is made larger so that the banding exceeds the allowance range, and thus it is not preferable.

Third Embodiment

Next, an apparatus according to the third embodiment will be explained with reference to FIG. 10. Since the basic configuration of the apparatus of this embodiment is also same as that of the above-mentioned embodiment, redundant explanation is omitted, and the configuration characteristic of this embodiment will be described. Moreover, the same numerals are applied to the members having the same functions as those of the above-mentioned embodiment.

Figure 10:
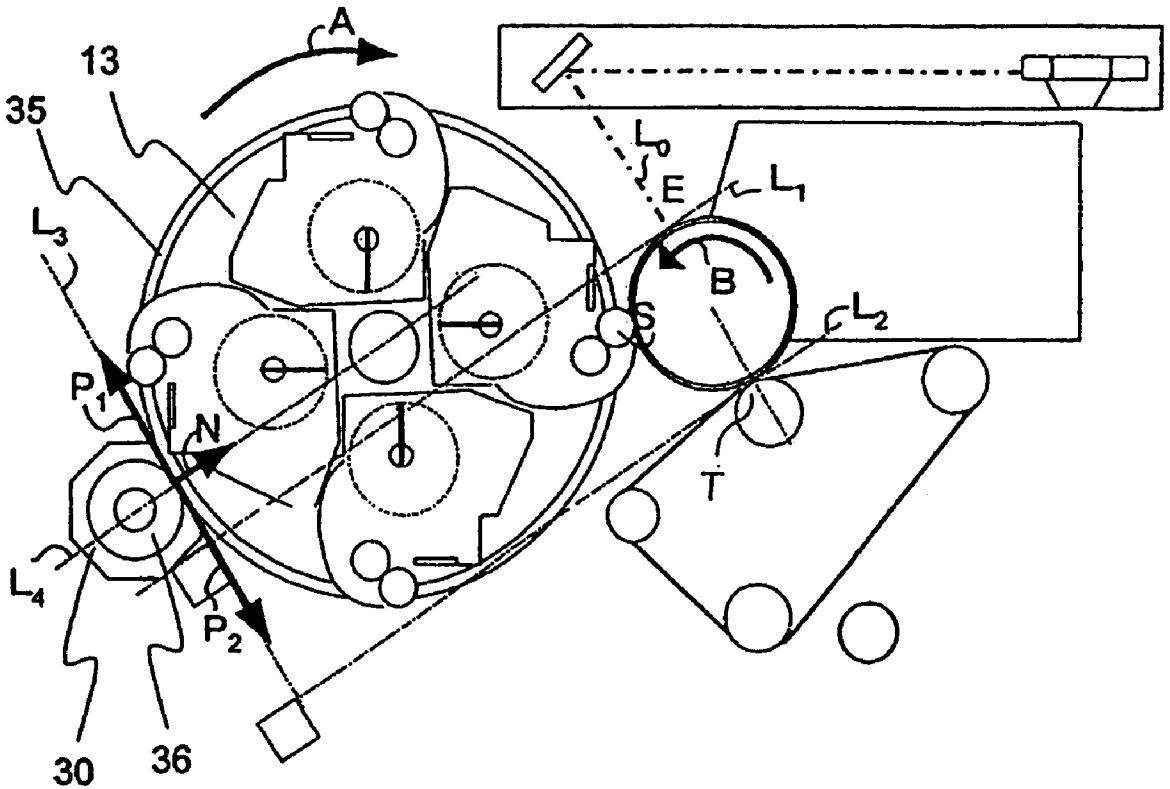
FIG. 10 is an explanatory diagram of an embodiment with the driving motor and the developing rotary provided according to the friction transmitting drive.
Figure 11:
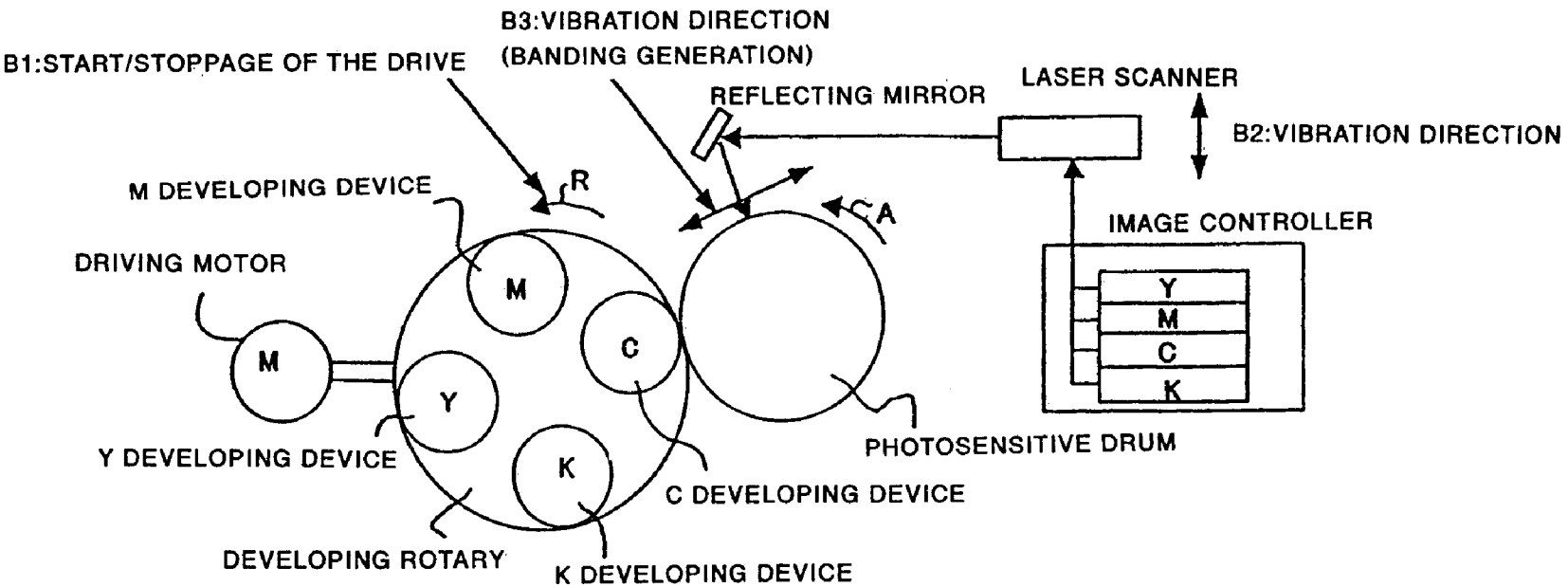
FIG. 11 is an explanatory diagram for the banding.
Figure 12:
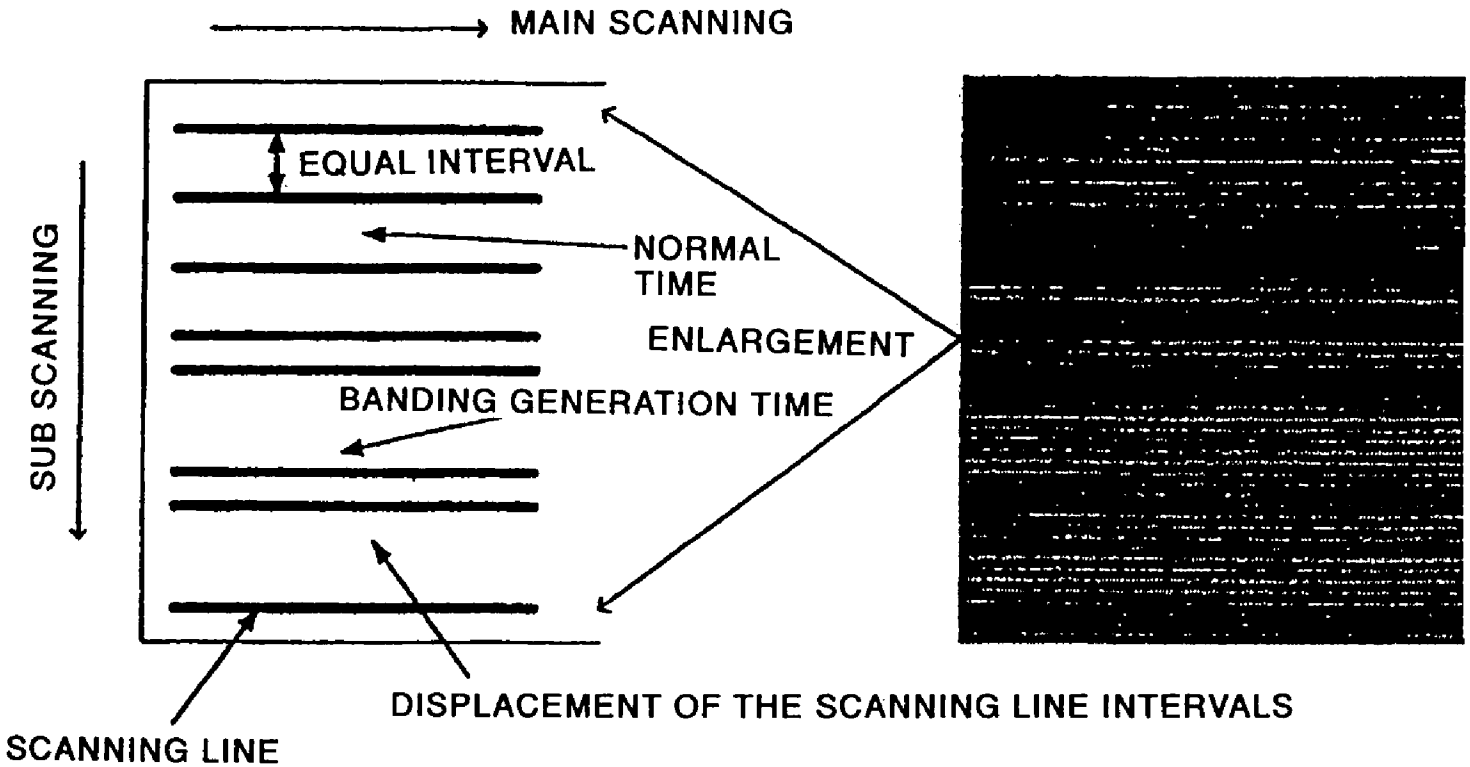
FIG. 12 is an explanatory diagram for the banding.

FIG. 10 shows an example with the driving motor 30 and the developing rotary 13 having the configuration of the friction transmission drive without using the gear drive. The pinion of the driving motor 30 and the pinion of the rotary are provided with a metal with the anti sliding treatment of the ceramic coating as the drive transmitting means. In FIG. 10, the numeral 35 is a friction ring provided in the developing rotary 13, 36 a friction pinion provided in the driving motor 30, and N the force needed for the drive transmission.

In the case of the friction drive, since the force pressure N is applied always constantly, the fluctuation factor for generating the vibration is only the forces P1 and P2 in the tangent direction generated at the time of starting and stopping the drive of the motor. Then, in the case the tangent L3 at the friction drive transmitting position, and the sub scanning tangent L1 at the exposing position and the sub scanning tangent 12 at the transfer position have the relationship substantially orthogonal with each other, since the vibration due to the drive or the stoppage of the driving motor 30 is not generated in the sub scanning direction, the banding generation can be restrained. The "relationship substantially orthogonal with each other" here denotes the range of the angle formed by the tangent L3 and the tangent L1, and the angle formed by the tangent L3 and the tangent L2 is within 90°±10°. In the case the angle is less than 80°, or more than 100°, the banding exceeds the allowable level due to the increase of the force applied in the rotary rotation axis direction by the drive transmission, and thus it is not preferable.

Moreover, in addition to the configuration of this embodiment, a timing belt can be used in the rotary drive. By arranging the direction of the belt tension generated by starting or stopping the drive of the motor and the above-mentioned sub scanning direction substantially perpendicular, the banding problem can be solved.

Other Embodiments

Although the vibration at the transfer position T and the exposing position E is reduced in the above-mentioned embodiments, the banding preventive effect can be obtained by arranging the direction of the straight line linking the drive transmitting position of the rotary 13 and the driving motor 30 for driving the rotary 13 and the rotation center of the above-mentioned rotary 13 within the positive and negative pressure angle with respect to at least one selected from the group consisting of the sub scanning tangent direction at the exposing position E and the sub scanning tangent direction at the transfer position T. For example, in the case of a structure with the vibration hardly transmissible at the transfer position T, the banding preventive effect can be obtained by the configuration of reducing the vibration mainly at the exposing position E. On the other hand, in the case of a structure with the vibration hardly transmissible to the exposing position E, the banding preventive effect can be obtained by the configuration of reducing the vibration mainly at the transfer position T.

This application claims priority from Japanese Patent Application No. 2004-22747 filed Jan. 30, 2004, which is hereby incorporated by reference herein.

What is claimed is:

1. An image forming apparatus comprising:

an image bearing member rotatable with carrying an electrostatic image;

an exposing means for forming the electrostatic image by executing a scanning exposure at an exposing position with respect to the image bearing member;

a developing means for developing the electrostatic image at a developing position, comprising a plurality of developing devices, a rotating member including a first gear portion for receiving a driving force to rotate, rotatable while supporting the plurality of the developing devices, and a driving means including a second gear portion for transmitting the driving force to the first gear portion with being geared with the first gear portion at a drive transmitting position and selectively moving the plurality of the developing devices to the developing position, wherein an angle θe(°) formed by a straight line linking a rotation center of the rotating member and the drive transmitting position and a tangent of the image bearing member at the exposing position satisfies the following relationship with the premise that a pressure angle of the gear in the first and second gear portions is α(°) and the image bearing member rotating direction is positive:

$-\alpha \leqq \theta e \leqq \alpha$, in which $14° \leqq \alpha \leqq 20°$.

2. An image forming apparatus comprising:

an image bearing member rotatable with carrying an electrostatic image;

an exposing means for forming the electrostatic image by executing a scanning exposure at an exposing position with respect to the image bearing member;

a developing means for developing the electrostatic image at a developing position, comprising a plurality of developing devices, a rotating member including a drive receiving portion for receiving a driving force to rotate, rotatable while supporting the plurality of the developing devices; and a driving means including a drive transmitting portion for transmitting the driving force to the drive receiving portion with abrasion by being contacted with the drive receiving portion at the drive transmitting portion and selectively moving the plurality of the developing devices to the developing position, wherein an angle formed by a tangent at the drive transmitting position of the rotating member and a tangent at the exposing position of the image bearing member is substantially a right angle.

3. An image forming apparatus according to claim 1 or 2, wherein the driving means starts rotation of the rotating member before the scanning exposure by the exposing means, and rotation of the rotating member is stopped during the scanning exposure by the exposing means.

* * * * *

UNITED STATES PATENT AND TRADEMARK OFFICE

CERTIFICATE OF CORRECTION

PATENT NO. : 7,248,822 B2
APPLICATION NO. : 11/041203
DATED : July 24, 2007
INVENTOR(S) : Masahiko Yokota et al.

It is certified that error appears in the above-identified patent and that said Letters Patent is hereby corrected as shown below:

Title page, item (57) ABSTRACT

Line 15, "an pressure" should read --a pressure--.

COLUMN 1

Lines 28 through 30, "developing with the developing device storing a predetermined color faced with respect to the above-mentioned photosensistive drum," should read --developing an image with the developing device in a manner that each developing device, which respectively stores a predetermined color, faces with the photosensitive drum,--.

COLUMN 4

Line 33, "time, of" should read --time of--.
Line 34, "and" should read --and FIG. 5B--.
Line 35, "time, of" should read --time of--.

COLUMN 5

Line 59, "contacted" should read --contacting--.

COLUMN 6

Line 39, "form" should read --from--.

COLUMN 8

Line 43, "drum 21 a the" should read --drum 21 at the--.

COLUMN 10

Line 66, "(2α)," should read --(2α).--.

COLUMN 11

Line 2, "is functioned" should read --is given--.
Line 15, "P1=P2," should read --P1=P2.--.
Line 19, "is barely functioned" should read --is hardly given--.

UNITED STATES PATENT AND TRADEMARK OFFICE

CERTIFICATE OF CORRECTION

PATENT NO. : 7,248,822 B2
APPLICATION NO. : 11/041203
DATED : July 24, 2007
INVENTOR(S) : Masahiko Yokota et al.

It is certified that error appears in the above-identified patent and that said Letters Patent is hereby corrected as shown below:

COLUMN 12

Line 27, "tangent 12" should read --tangent L2--.

Signed and Sealed this

Eighth Day of April, 2008

JON W. DUDAS
*Director of the United States Patent and Trademark Office*